United States Patent [19]

Lacey

[11] 4,183,099

[45] Jan. 15, 1980

[54] ATHLETIC KNEE PROTECTION DEVICE

[76] Inventor: Richard J. Lacey, T-161, Lake Lotawana, Lee's Summit, Mo. 64063

[21] Appl. No.: 938,635

[22] Filed: Aug. 31, 1978

[51] Int. Cl.[2] ..... A41D 13/06

[52] U.S. Cl. ..... 2/24; 128/80 C; 128/80 F

[58] Field of Search ..... 2/22, 24; 128/80 C, 128/80 F; 24/68 R

[56] References Cited

U.S. PATENT DOCUMENTS

| | | | |
|---|---|---|---|
| 2,144,641 | 1/1939 | Snyder | 128/80 C |
| 3,528,412 | 7/1967 | McDavid | 2/22 X |
| 3,575,166 | 4/1971 | Rosman | 2/22 X |
| 3,786,804 | 1/1974 | Lewis | 128/80 C |
| 3,799,158 | 3/1974 | Gardner | 128/80 C |
| 3,898,697 | 8/1975 | Whitehead | 128/80 C |
| 4,097,932 | 7/1978 | Lacey | 2/24 |

*Primary Examiner*—Louis Rimrodt
*Attorney, Agent, or Firm*—John A. Hamilton

[57] ABSTRACT

A knee protection device for use by athletes, particularly football players, consisting of a jointed rigid reinforcing bar adapted to be worn at the inside of the knee, with its pivot coaxial to the transverse axis of the knee joint, and extending above and below the joint, the surface of the bar next to the leg being specially conformed to the leg whereby to be firmly positioned when pressed firmly against the leg, a pair of straps encircling the leg and reinforcing bar respectively above and below the knee joint, and pressing the bar firmly against the leg, and an impact-operated strap tightening device interposed in each strap and operable to tighten the strap further whenever the knee receives a blow at its outer side.

8 Claims, 9 Drawing Figures

ATHLETIC KNEE PROTECTION DEVICE

Figure 1:
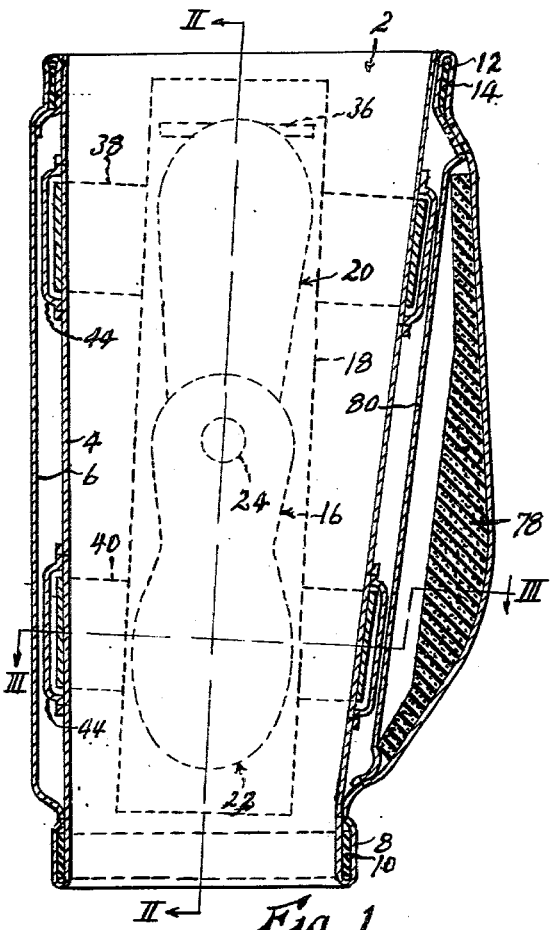

This invention is an improvement over the device shown in my prior U.S. Pat. No. 4,097,932, issued July 4, 1978. It relates to knee protection devices for use by athletes. It has been conceived principally for use by football players, although as will be readily apparent it could be used by any athlete engaged in a sport involving violent physical contact.

The high rate of knee injuries to football players is well known. They can be very serious, often ending the athletic careers of the victims, and often subjecting them to lifelong disabilities as well. Such injuries, most commonly, occur when the knee is subjected to a heavy blow at its outer side, particularly when the foot is planted firmly on the ground, with the knee joint extended to straighten the leg. They can cause often extremely severe tendon, sinew and cartilage damage. The overall object of this invention is the provision of a device which will greatly reduce the rate of incidence of such injuries, and reduce the gravity of such injuries if they do occur despite the use of the device.

My prior patent disclosed a device including a jointed, rigid reinforcing bar adapted to be worn along the inner side of the leg, extending above and below the knee joint and with its pivot disposed coaxially with the lateral axis of the knee, a pair of straps adapted to encircle the leg, and the reinforcing bar, respectively above and below the knee, and a strap tightener disposed in each strap, at the outer side of the knee, and operable by a blow thereon to tighten the strap very tightly, whereby the bar could reinforce the knee against injury. The straps cannot be worn at maximum tightness at all times, since to do so would interfere with the user's comfort and agility, and also inhibit the blood circulation in his legs. The tighteners thus acted to supply maximum leg support only when needed, that is, at the moments of impact. However, when the straps were not at maximum tension, with the strap tighteners not actuated, there was always the likelihood that the bar, straps and strap tighteners could move or become disarranged relative to the leg, which cannot be permitted since this could destroy the coaxiality of the reinforcing bar pivot with the knee axis, and hence interfere with free flexing of the knee joint. Accordingly, my prior device relied on a tubular fabric boot adapted to be worn over the leg at the knee joint, securely fastened to the user's leg, or trousers, and having a system of pockets for containing the reinforcing bar and strap tighteners, to hold the assembly in place in normal use, that is, until the knee receives a blow at its outer side to actuate the strap tighteners. However, a weakness of this prior form was that the boot did not always hold the reinforcing bar accurately in position with total reliability, due to the inherent yieldability of the fabric of which the boot was formed, and to the violent physical movements in which the user is often engaged.

Accordingly, the primary object of the present improvement is the provision of means operable to hold the reinforcing bar accurately in proper position relative to the knee, with total reliability, and substantially independently of any boot or the like. Generally, this object is accomplished by so configurating the surface of the reinforcing bar engaging the leg that, when pressed firmly against the leg, it conforms to the leg surface, and to the underlying bone structure, to hold it accurately in position. The straps provide sufficient pressure for this purpose well within the limits of strap tension dictated by comfort, agility and blood circulation of the user, while the strap tighteners still function to provide maximum strap tension when needed at moments of impact. The fabric boot is still employed, to conceal the operating parts and to provide support for the strap tightening devices, but so far as the reinforcing bar is concerned, it will remain accurately in position even in the complete absence of a boot.

Another object is the provision of a device of the character described in which the special configuration of the reinforcing bay may be "averaged" to fit any leg with reasonable accuracy, and it may also be individually molded to the leg of a specific person, for still greater comfort and efficiency.

Other objects are simplicity and economy of construction, and efficiency and dependability of operation.

Figure 2:
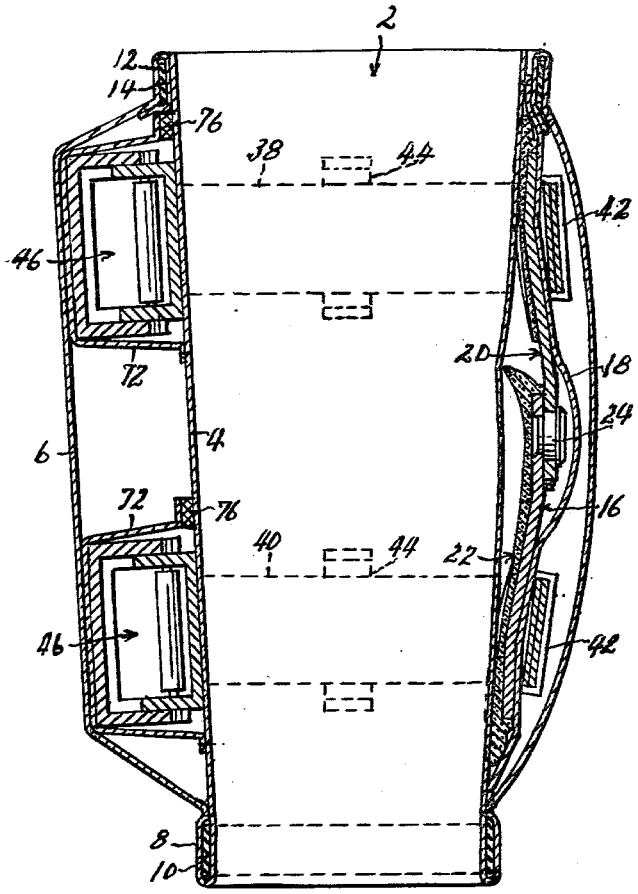
Figure 3:
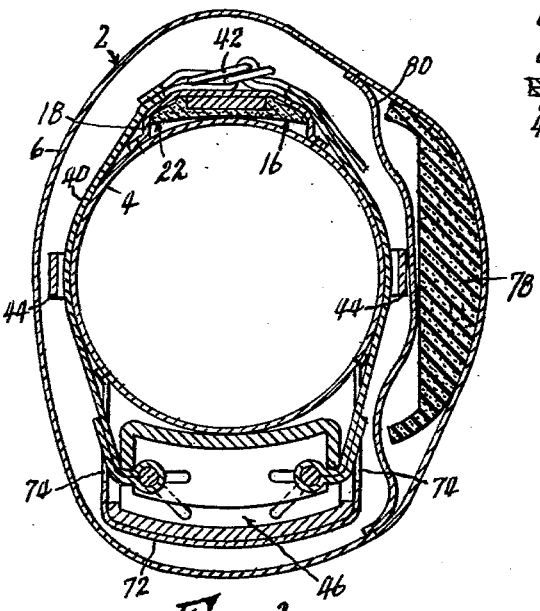
Figure 4:
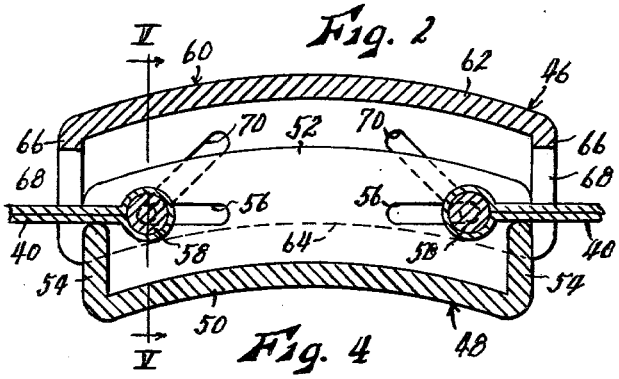
Figure 5:
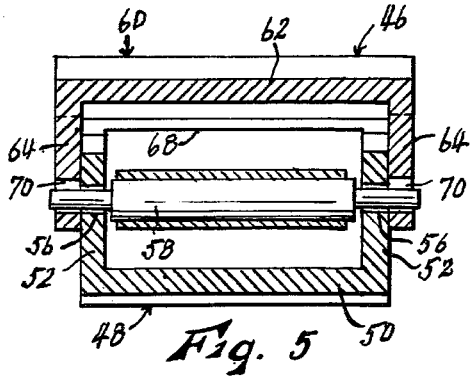
Figure 6:
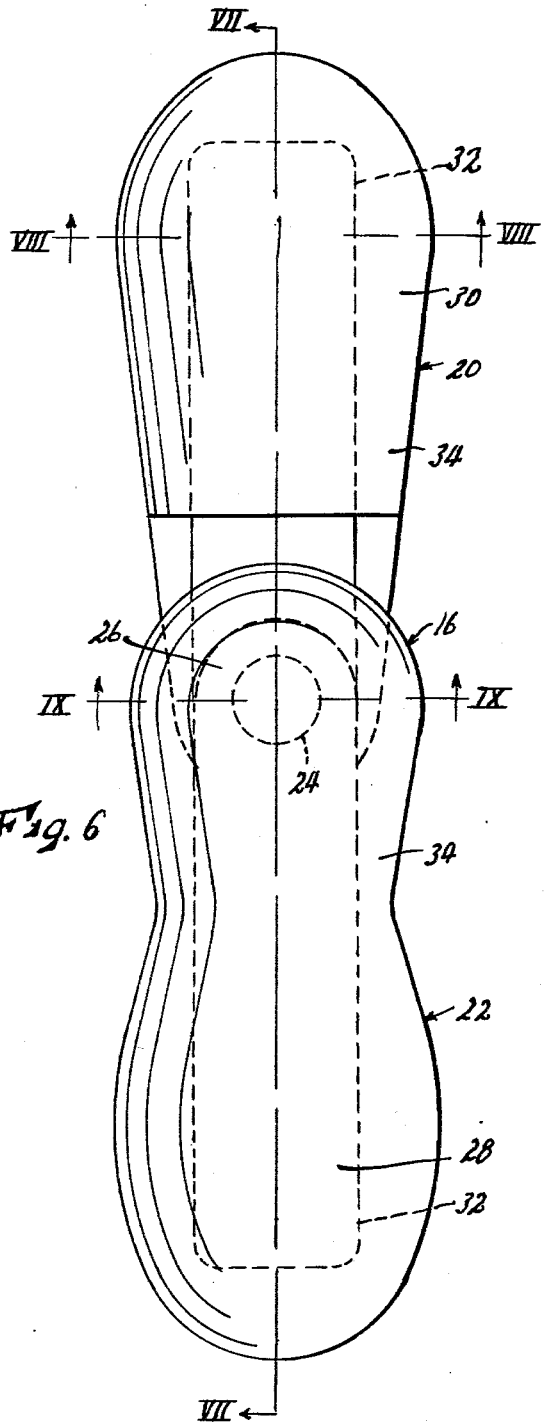
Figure 7:
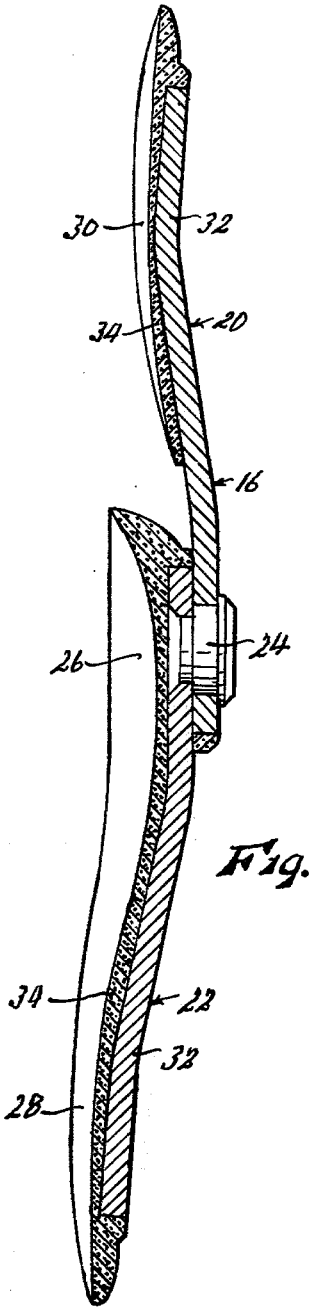
Figure 8:
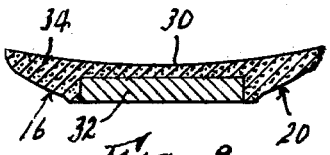
Figure 9:
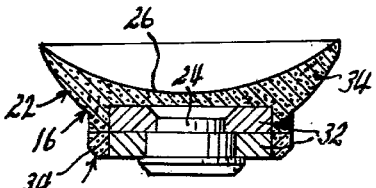

With these objects in view, as well as other objects which will appear in the course of the specification, reference will be had to the accompanying drawing, wherein:

FIG. 1 is a vertical longitudinal sectional view, taken on a front-to-rear plane, of an athletic knee protection device embodying the present invention, with various layers somewhat separated and spread apart for clarity, FIG. 2 is a sectional view taken on line II—II of FIG. 1, FIG. 3 is a sectional view taken on line III—III of FIG. 1, FIG. 4 is an enlarged, longitudinal sectional view of one of the strap tighteners, including portions of its associated strap, FIG. 5 is a sectional view taken on line V—V of FIG. 4, FIG. 6 is an enlarged, inner face view of the reinforcing bar only, FIG. 7 is a sectional view taken on line VII—VII of FIG. 6, FIG. 8 is a sectional view taken on line VIII—VIII of FIG. 6, and FIG. 9 is a sectional view taken on line IX'IX of FIG. 6.

Like reference numerals apply to similar parts throughout the several views. The device shown is adapted for use on the right knee. A similar device, with necessary reversals of arrangement, may be used on the left knee. The device includes a tubular "boot" 2 adpated to be slipped over the leg from the foot to encompass the knee, extending both above and below the knee joint. It includes an inner sleeve 4 and an outer sleeve 6, both formed of strong, pliable cloth, preferably an elastic or "stretch" cloth, said sleeves being joined together around their lower edges by a hemmed tube 8 including an elastic band 10 for gathering the boot snugly about the calf portion of the wearer's leg. The upper end of inner sleeve 4 is adapted to be attached securely to the thigh portion of the wearer's leg by any suitable means, for example by adhesive tape. Outer sleeve 6 is provided around its upper edge with a hemmed tube 12 in which is carried an elastic band 14 for gathering sleeve 6 snugly about sleeve 4. Boot 2 carries the remaining elements of the device.

A reinforcing bar indicated generally by the numeral 16 is contained snugly in a pocket formed by a strip of cloth 18 stitched to the outer surface of inner sleeve 4, so as to extend longitudinally of the boot at the inner side of the knee. As shown, said reinforcing bar consists of an upper section 20 and a lower section 22, pivotally connected together at their contiguous ends by a shouldered pivot bolt 24. The bar is so supported that the axis of pivot bolt 24 is coaxial with the lateral axis of the wearer's knee. The bar support may be performed by boot 2, and was so supported in my prior patent, but in the present device is supported primarily by the configuration of the inner surface of the bar, which is the surface thereof confronting the leg, to the contour of the wearer's flesh and underlying bone structure, when said bar is presses firmly against the leg by the straps to be described. For this purpose, lower bar section 22 extends somewhat above pivot 24, and has a partially spherical socket 26 formed in the inner surface thereof (see FIGS. 6–9) generally coaxially with pivot 24, the lower portion of section 22 is generally cylindrically curved, at its inner surface, about an axis generally at right angles to the axis of pivot 24, as indicated at 28, and the inner surface of upper bar section 20 is similarly cylindrically curved as indicated at 30. Thus it will be seen that when the upper and lower bar sections are pressed firmly against the leg, respectively by the two straps to be described, socket 26 engages over the knob of bone underlying the flesh at the inner side of the wearer's knee joint, thereby providing a point of central support for the reinforcing bar and guaranteeing coaxiality of pivot 24 with the knee joint, while curvatures 28 and 30 engage respectively the tibia and femur bones underlying the wearer's flesh respectively below and above the knee, thereby insuring that the bar sections will pivot accurately with the relative movements of the wearer's thigh and calf at the knee joint. Thus, in essence, reinforcing bar 16 makes no reliance at all on boot 2 for its positioning and support.

The above description of the configuration of the inner surface of bar 16 is of course generalized and simplified to some extent. The actual curvatures required are necessarily complex, being somewhat different for each individual wearer in order to provide maximum comfort and efficiency. By carefully "averaging" the configurations required for a large number of people, a configuration may be arrived at which will provide reasonable comfort and efficiency for nearly any user, and each bar section 20 and 22 may be of one piece construction, preferably being formed of a light weight material such as aluminum or high impact plastic. To provide an individual fit, each bar section may be formed of a base bar 32 of, for example, aluminum, covered at its inner surface with a layer of material 34 having the desired configuration at its inner surface. Material 34 is of a type of plastic, resin or the like which was originally of a plastically moldable consistency, and was originally shaped by pressing it firmly against the user's leg while still in a moldable state, while flexing the knee repeatedly to insure coaxiality of pivot 24 with the knee joint. The material may then be allowed to set, and its edge contour and outer surface finally shaped by grinding or other similar process. Alternatively, of course, bar sections so molded to an individual wearer may be used as templates or patterns for the production of one-piece bar sections of any desired material. The cloth strip 18 forming the bar pocket of boot 2 is divided adjacent one end of the bar, as indicated at 36 in FIG. 1, to permit removal of the bar for laundering of the boot.

A pair of strong fabric straps 38 and 40 encircle inner sleeve 4 of the boot respectively above and below pivot 24, so as to also pass respectively around upper and lower sections 20 and 22 of the reinforcing bar. The straps are disposed between the inner and outer sleeves of the boot. The separable ends of each strap are releesably joined by a buckle 42 of a type, such as a sliding friction type, operable to permit the straps to be drawn to any desired degree of tightness, in a continuous adjustment. Preferably, the buckles are disposed over reinforcing bar 16 as shown. The straps may be further positioned by cloth keepers 44 stitched to the outer surface of inner sleeve 4. Intermediate the ends of each strap, so as to be disposed at the outer side of the leg of the wearer, a strap tightening device indicated generally by the numeral 46 is interposed in said strap.

As shown in detail in FIGS. 4 and 5, each strap tightener 46 includes a base member 48 formed of light weight metal or high impact plastic, and having the form of a shallow rectangular cup the floor 50 of which rests against the wearer's leg, with sleeve 4 therebetween, and which is curved to conform generally to the contour of the leg, a pair of parallel side walls 52 disposed generally parallel to the plane of the strap loop, and a pair of parallel end walls 54 disposed generally at right angles to the plane of the strap loop. Each of side walls 52 has a pair of slots 56 formed therethrough, said slots being generally parallel to floor 50 and being disposed respectively adjacent end walls 54. A pair of pins 58 extend transversely between side walls 52, and have reduced end portions, the reduced end portions of each pin being engaged in one corresponding pair of slots 56 for transverse sliding movement therein. The strap 38 or 40 is divided at the tightener and the resulting strap ends are affixed respectively around the two pins 58, as shown, and extend outwardly from the base over the rounded free outer edges of end walls 54. The tension of the strap normally positions pins 58 in the distal ends of slots 56.

Strap tightener 46 also includes a cap member 60 formed of the same material as base 48 and likewise of rectangular cup form, although inverted with respect to said base. It has a broad smooth outer wall 62 generally parallel to base floor 50, side walls 64, and end walls 66, said side and end walls being telescoped slidably over the corresponding side and end walls of the base. End walls 66 are windowed as at 68 to accomodate the strap ends extending outwardly from pins 58. Side walls 64 each have a pair of slots 70 formed therethrough, respectively adjacent end walls 66, and inclined so as to converge in a direction away from floor 50 of base 48. The reduced ends of pins 58 also extend into the corresponding slots 70 for transverse sliding movement therein. When pins 58 are engaged in the distal ends of slots 56 by strap tension, they are engaged also in the ends of slots 70 closest to base floor 50, so that cap 60 is also maintained in an outward position relative to the base by strap tension. However, if a blow is delivered to outer wall 62 of the cap, as when a ball carrier is hit at the knees by a tackler in a football game, the cap is forcibly telescoped inwardly over the base, and the slots 56 and 70 cooperate to force pins 58 closer together, thereby tightening the strap around the wearer's leg and reinforcing bar 16.

Each strap tightener is carried in a pocket formed by a cloth path 72 stitched to the outer surface of inner boot sleeve 4. Said pocket is apertured at its sides, as indicated at 74 in FIG. 3, to accomodate the strap connections to the tightener, and is releasably closed at its top edge by any suitable fastener 76, such as the commonly known "Velcro" fastener, securing said edge to boot sleeve 4. By releasing fasteners 76, and disengaging buckles 42, the straps and strap tighteners may be removed from the boot for easy laundering of said boot. A knee pad 78, consisting of a thick, formed slab of natural or synthetic foam, is carried in a pocket formed by a cloth patch 80 stitched to the inner surface of outer boot sleeve 6, so as to overlie the front of the wearer's knee. Patch 80 may also be divided, as is cloth patch 18 forming the pocket for reinforcing bar 16, to permit removal of the pad for laundering of the boot.

To apply the device, outer boot sleeve 6 is first everted downwardly from inner sleeve 4, whereby to expose the outer surface of the latter, and straps 38 and 40 loosened. The boot is then drawn upwardly over the leg from the foot, until the inner sleeve encompasses the knee, with reinforcing bar 16 being pressed manually against the leg in generally proper relation to the knee to gauge the position to which the boot should be pulled. Then the upper edge of inner sleeve 4 is securely taped to the wearer's leg to fasten it in position. Straps 38 and 40 are then pulled up as tight as may be comfortably endured for extended periods of time, but not excessively tight, taking care that the reinforcing bar is held accurately in position as the straps are tightened. They should not be tightened at this time to the extent that reinforcing bar 16 could adequately reinforce the knee joint itself against heavy lateral blows, since the flesh of the leg is of course yieldable to a considerable degree, and tightening the straps to this high degree, to force the flesh to yield, would interfere with blood circulation in the wearer's leg, and would in some degree interfere with the wearer's agility and freedom of movement, since knee flexure is somewhat complex, not all of its movement being on a single fixed axis. Thus at least some yieldability in the positioning of the reinforcing bar relative to the leg is normally required. Experience is the best teacher in learning how tightly to draw the straps when applying the device. However, the configuration of the inner surface of the reinforcing bar, as described, provides for accurate positioning of said bar even when the straps are not fully tight. Particularly, the engagement of socket 26 of the bar over the knob of bone underlying the flesh at the inner side of the knee keeps bar pivot 24 in coaxial alignment with the knee axis, especially preventing the bar from tending to work downwardly along the leg, as it normally tends to do as a result of the violent movements in which the wearer often engages, and of the natural downward taper of the leg, while the transversely cylindrical curvature of the extended portions of the bar sections causes them to "locate", and be positioned by, the femur and tibia bones underlying the flesh above and below the knee, so that said bar sections accurately follow any flexing of the knee. This positioning effect of the special bar configuration is provided by straps 38–40 well within the tension limits of the straps necessary to permit wearing thereof for extended periods of time, as outlined above. The described pre-tensioning of the straps is also ample to draw pins 58 of strap tighteners 46 to the distal ends of slots 56 of the tightener bases 48, and hence to telescope tightener caps 60 outwardly relative to said bases. My prior device relied entirely on the boot and its pockets to hold the reinforcing bar accurately relative to the knee when the straps were merely pre-tensioned, and was somewhat inefficient in this phase of its operation. In the present device, the reinforcing bar is held accurately in position by its special configuration, with only normal pre-tensioning of the straps, entirely independently of the boot. Finally, outer sleeve 6 of the boot is everted upwardly around the inner sleeve, to the position shown in FIGS. 1–3, in which position it conceals the straps, strap tighteners, etc., and positions knee pad 78 properly, and is secured in this position by elastic band 14. The upper edge of the outer sleeve, as well as the lower edge of the boot, could also be securely taped to the wearer's leg, if desired. It is preferred that upper bar section 20 be disposed outwardly of lower section 22 at their pivotal connection, and that spherical socket portion 26 be formed in the lower section. This permits said socket configuration to be substantially closed or "complete" at its upper edge, whereby it can best combat the natural tendency of the bar, previously described, to work downwardly along the leg. At its lower edge, the socket configuration is obviously interrupted, merging smoothly into the transversely cylindrical curvature of the extended portion of the lower bar section, but this has no harmful effect on the vertical support of the bar.

Then in operation, it will be apparent that whenever the wearer receives a heavy blow at the outer side of the knee, as in some football tackles, the blow will be received on the outer walls 62 of caps 60 of the strap tighteners, telescoping said caps inwardly over tightener bases 48, which are based substantially against the wearer's leg. This operates the tighteners to tighten the straps, as previously described. If the straps are already pre-tensioned as tightly as comfortably possible for normal wear, as already described, the tighteners can draw them extremely tight indeed. This draws the reinforcing bar into much firmer and tighter relation to the bone structure of the wearers leg, compressing the flesh against said underlying bone structure, whereby it offers, by reason of its rigidity against lateral flexure, a very strong support to the leg, resisting injurious lateral flexure of the knee joint. The straps could of course be manually tightened to the same degree as provided by the tighteners, but this would not be practical or permissable for the reasons already discussed. The tighteners provide the extreme strap tension only at the moments it is needed, that is, at the moments of impact, and thereafter immediately relax the extreme tension. Boot 2, while no longer required to maintain the reinforcing bar in accurate relation to the knee in normal use, as was necessary in my prior device, since this function is now performed by the special configuration of the reinforcing bar with only normal and permissable pre-tensioning of the straps, is nevertheless still useful, in that it conceals the primary operating parts, carries knee pad 78, tends to protect others from injury who might otherwise come into rough contact with the primary operating parts, and serves as a support for strap tighteners 46, since it is almost inevitable that said tighteners, due to their bulk, will have appreciable weight even when built of the lightest materials available.

While I have shown and described a specific embodiment of my invention, it will be readily apparent that many minor changes of structure and operation could be made without departing from the spirit of the invention.

What I claim as new and desire to protect by Letters Patent is:

1. An athletic knee protection device compirising:

a. an elongated reinforcing bar consisting of two rigid sections pivotally joined at their contiguous ends, said bar being adapted to be extended along a wearer's leg at the inner side thereof, with the axis of the pivotal connection of said bar sections coaxial with the lateral axis of the knee joint, the surface of said bar adjacent the leg having a special configuration operable to engage over and be positioned by the wearer's flesh and underlying bone structure, when said bar is pressed firmly against the leg, said special configuration including a generally spherical socket configuration formed in the inner surface on one of said bar section in generally coaxial relation to the pivotal connection of said bar sections, whereby to engage over and be positioned accurately relative to the leg by the knob of bone underlying the flesh of the leg at the knee joint thereof, and b. a pair of straps adapted to encircle the leg of the wearer, and said reinforcing bar, respectively above and below the knee joint and the pivotal connection of said bar sections, and operable to press said reinforcing bar firmly against the wearer's leg.

2. A device as recited in claim 1 wherein said special configuration of said reinforcing bar enables said straps to hold said bar accurately in position relative to the leg with only a partial tightening thereof, as opposed to full tightening thereof, whereby the device may be worn comfortably, and with the addition of a strap tightener interposed in each of said straps at the outer side of the wearer's leg, and operable by the impact of a blow thereagainst to tighten said strap to full tightness, whereby to force said bar into closer proximity to the bone structure of the leg by compressing the layers of flesh therebetween, and hence to provide better lateral support for the knee joint.

3. A device as recited in claim 2 wherein said special configuration of said reinforcing bar additionally includes a generally cylindrical curvature of the inner surfaces of the bar sections, except immediately adjacent the pivotal connection of said bar sections, generally about axes normal to the axis of said pivotal connection, whereby to engage over and be positioned accurately relative to the leg by the long leg bones underlying the flesh above and below the knee joint.

4. A device as recited in claim 3 wherein the upper of said bar sections is disposed outwardly of the lower of said bar sections at the pivotal connection thereof, said socket configuration being formed in the inner surface of said lower section, being substantially closed at its upper and side edges and merging at its lower edge into the cylindrical curvature of the extended portion of said lower bar section.

5. A device as recited in claim 3 wherein each of the sections of said reinforcing bar comprises:

a. a rigid, longitudinally extending base member remote from the surface thereof in which said special configuration is formed, and b. a face portion in which said special configuration is formed, and constituting a solidified but originally moldable material, whereby it may be molded against the leg of an individual wearer, while still of a moldable consistency, whereby said special configuration is molded to the specific requirements of said individual wearer, before being allowed to solidify.

6. A device as recited in claim 3 wherein each of said strap tighteners comprises:

a. a base member effectively seated against the wearer's leg, b. a cap member carried by said base member and extending outwardly from the latter, but being capable of inward movement relative thereto, and c. operating means actuated by inward movement of said cap member relative to said base member, occasioned by a blow on said cap member, to tighten said strap.

7. A device as recited in claim 3 with the addition of a tubular fabric boot adapted to be worn over the wearer's leg at the knee, extending above and below the knee joint, and being securely affixable to the leg as by adhesive tape, said boot having pockets formed therein for containing said reinforcing bar and said strap tighteners.

8. A device as recited in claim 7 with the addition of a resilient knee pad adapted to be positioned forwardly of the knee to protect it against injury, said pad being carried in a pocket formed in said boot.

* * * * *